United States Patent [19]

Harada

[11] Patent Number: 4,875,053

[45] Date of Patent: Oct. 17, 1989

[54] DRIVE CONTROL DEVICE FOR AN ELECTRICALLY-DRIVEN EXTENDING AND RETRACTING ANTENNA

[75] Inventor: Jiro Harada, Tokyo, Japan

[73] Assignee: Harada Kogyo Kabushiki Kaisha, Tokyo, Japan

[21] Appl. No.: 210,007

[22] Filed: Jun. 22, 1988

[30] Foreign Application Priority Data

Sep. 30, 1987 [JP] Japan ..... 62-244338

[51] Int. Cl.[4] ..... H01Q 1/10

[52] U.S. Cl. ..... 343/903; 343/715; 343/900

[58] Field of Search ..... 343/715, 883, 889, 900, 343/901, 903; 318/603

[56] References Cited

U.S. PATENT DOCUMENTS

| | | | |
|---|---|---|---|
| 4,330,782 | 5/1982 | Hashimoto et al. | 343/903 |
| 4,506,266 | 3/1985 | Mizuno et al. | 343/903 |
| 4,649,398 | 3/1987 | Yamamoto et al. | 343/903 |

FOREIGN PATENT DOCUMENTS

| | | | |
|---|---|---|---|
| 2832061 | 1/1980 | Fed. Rep. of Germany | 343/903 |
| 8704567 | 7/1987 | World Int. Prop. O. . | |

*Primary Examiner*—Rolf Hille

*Assistant Examiner*—Doris J. Johnson

*Attorney, Agent, or Firm*—Koda and Androlia

[57] ABSTRACT

A drive control device for an electrically-driven extending and retracting antenna such as an antenna on an automobile including a motor-driven rotary plate which makes approximately one revolution during the time for complete extension or retraction and has attached, on one side, a disk-shaped conducting part with a small cut-out. Of the three contacts, the first is ordinarily in contact with the disk-shaped conducting part, maintaining a state of electrical continuity, the second contact contacts the small cut-out when extension of the antenna is completed; and the third contact contacts the small cut-out when retraction of the antenna is completed. As a result, electrical continuity is maintained during extension or retraction of the antenna, but not when extension or retraction has been completed. The first and second contacts thus constitute a limit switch for antenna extension; and the first and third contacts constitute a limit switch for antenna retraction. As a result, the extension and retraction operating wire never sustains any unreasonable tensile or compressive forces as would be the case with a step-type drive control, where the drive motor operates for longer periods than required.

3 Claims, 6 Drawing Sheets

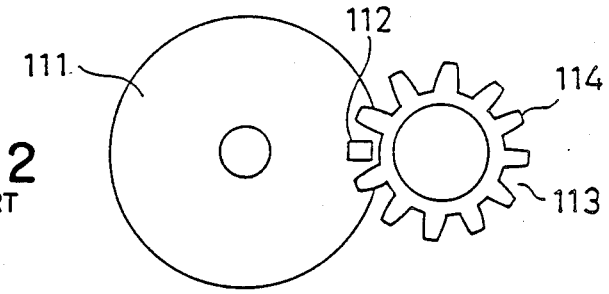
FIG. 12
PRIOR ART
FIG. 13
PRIOR ART
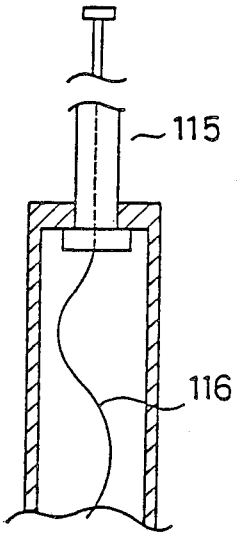

DRIVE CONTROL DEVICE FOR AN ELECTRICALLY-DRIVEN EXTENDING AND RETRACTING ANTENNA

BACKGROUND OF THE INVENTION

1. Field of the Invention

The present invention relates to a drive control device for an electrically-driven extending and retracting antenna, and particularly to an antenna mounted on a vehicle such as an automobile.

2. Prior Art

Generally, extending and retracting antennas consist of multiple electrically conducting tubes of different diameters installed one inside the other which are free to slide relative to each other in the manner of a telescope. A drive control device for such antennas comrises: (a) an antenna drive mechanism which consists of a motor, a gear mechanism, a clutch mechanism, a wire feed mechanism and an antenna extension and retraction operating wire, etc., and (b) a control circuit which consists of relay contacts which are operated by an extension/retraction operating switch, a transceiver set on-off switch or an ignition switch or the like and limit switches which detect the completion of the extension or retraction operation of the antenna and turn the drive mechanism off.

In drive control devices for electrically-driven extending and retracting antennas of the abovementioned type, the antenna is extended or retracted when the motor is caused to rotate in the forward or reverse direction via the operation of switches during the extending or retracting action of the antenna. When extension or retraction of the antenna is completed, a clutch mechanism comes into play to interrupt the linkage between the motor and the antenna. Immediately afterward, a limit switch is turned off on the basis of information indicating that the extension or retraction of the antenna has been completed, cutting off the power supply to the motor. A step-advance rotary mechanism is generally used to turn off the limit switch.

FIG. 12 is a rough structural diagram of a conventional step-advanced rotary mechanism used for on-off control of the limit switch. The clutch mechanism includes a rotary plate 111 which rotates as the antenna is extended or retracted. A feeding projection 112 is formed near the circumference of the rotary plate 111. A switch gear 113 with gear teeth 114 around its circumference rotates one step as a result of the feeding action of the feeding projection 112 each time the rotary plate 111 completes one rotation. When this switch gear 113 has rotated to an angle corresponding to the amount of antenna feed that occurs during extension or retraction of the antenna, this gear turns off a limit switch (not shown in the figures).

In conventional devices constructed as described above, however, problems have been encountered such as since the limit switch is turned off when switch gear 113 has rotated a prescribed number of steps, it is extremely difficult to cause the timing of the off action of the limit switch to correspond to the point in time when the antenna has actually completed its extension or retraction. Accordingly, in most cases, the system is designed so that the limit switch is turned off when the switch gear 113 has rotated one or two extra steps beyond the calculated value. Thus, turning off of the limit switch actually lags slightly behind completion of the extension or retraction of the antenna. As shown in FIG. 13, when the antenna is extended, the pushing action of the extension and retraction operating wire 116 continues even after extension of the antenna 115 has been completed. Because of this, an unreasonable force is applied to wire 116, causing it to bend as shown in the figure. This causes damage to the wire and shortens the useful life thereof. Conversely, when retraction of the antenna 115 is completed, excessive tensile force is applied to the wire 116 which also tends to damage the wire 116 shortening the useful life thereof and causing problems.

SUMMARY OF THE INVENTION

The object of the present invention is to provide a drive control device for an electrically-driven extending and retracting antenna which accurately cuts off the motor power supply at the point in time when extension or retraction of the antenna is completed (or immediately prior to the point in time), thereby preventing the application of unreasonable force to the antenna extension and retraction operating wire, so that a highly durable device is obtained offering highly reliable performance over a long period of time.

In order to eliminate the abovementioned problems and achieve this object, the present invention uses a rotary plate which is caused to rotate continuously via the rotation of a motor transmitted via a reduction gear, so that the rotary plate completes approximately one cycle, i.e., a rotation of about 235 degrees, in the time required to complete the extending or retracting action of the antenna. A disk-shaped conducting part with a small cut-out area in one part of its circumference is integrally installed on one side surface of the rotary plate. A first contact is installed which is ordinarily in contact with the disk-shaped conducting part, so that a state of electrical continuity is maintained. Furthermore, a second contact is installed which is in contact with the small cut-out area when extension of the antenna is completed and a third contact which is in contact with the small contact area when retraction of the antenna is completed. Thus, a state of electrical continuity is maintained during the extending or retracting action of the antenna, and a state of electrical non-continuity is created when the extension or retraction of the antenna is completed. Furthermore, the system is designed so that the first contact and second contact constitute a limit switch for antenna extension, and so that the first contact and third contact constitute a limit switch for antenna retraction.

Use of the above described means allows the present invention to exhibit an advantage in that the angle of rotation of the rotary plate at which the limit switch is to be turned off can be more accurately matched to the amount of wire feed required to extend or retract the antenna than is possible to obtain in conventional devices in which the limit switch is turned off using a switch gear which rotates in steps. In other words, errors due to the step action of the switch gear are eliminated. Accordingly, no excessive compressive force or tensile force is applied to the antenna extension and retraction operating wire upon completion of extension or retraction of the antenna.

BRIEF DESCRIPTION OF THE DRAWING

FIGS. 1 and 2 are front views which illustrate the essential parts of the device of the present invention;

FIG. 3 is a top view showing the various mechanisms centering on the gear mechanism;

FIG. 4 is an exploded oblique view of the main parts;

FIG. 5 is a cross section which illustrates the structure of the second and third gears;

FIGS. 6(*a*) and 6(*b*) are a cross section and a plan view, respectively, which illustrate the structure of the contact plate;

FIGS. 7 and 8 are an oblique view and an exploded oblique view of the contact assembly;

FIG. 9 is an oblique view which illustrates the structure of the bottom holder;

FIG. 10 is an oblique view which illustrates the structure of the leaf spring contacts;

FIG. 11 is a circuit diagram which illustrates the antenna drive control circuit; and FIGS. 12 and 13 are explanatory diagrams which illustrate a prior art conventional device.

DESCRIPTION OF THE PREFERRED EMBODIMENT

Figure 2:
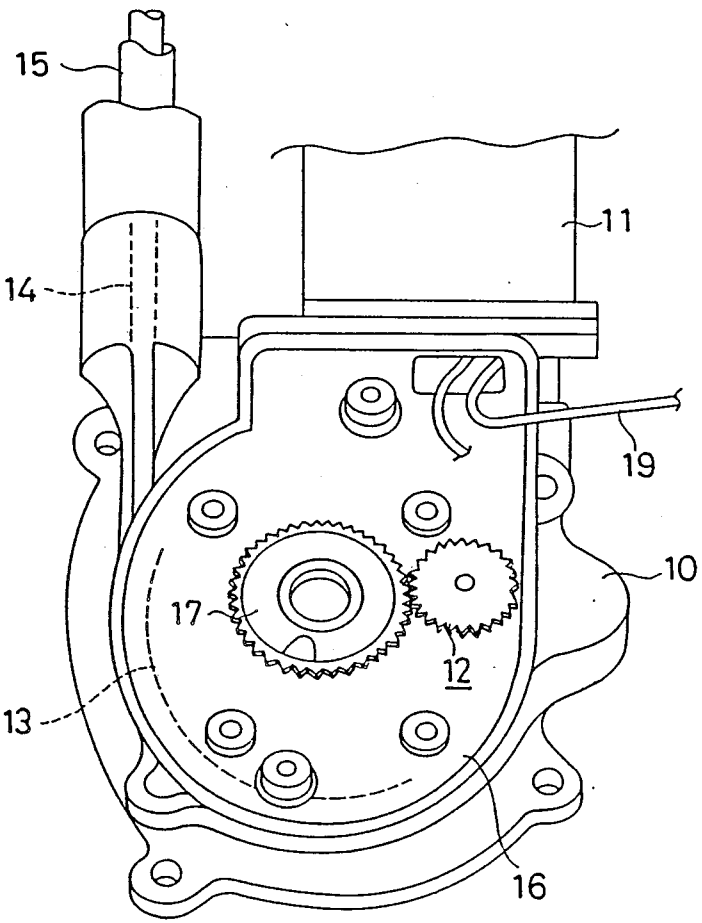
FIGS. 1 through 11 illustrate one embodiment of the present invention.
Figure 1:
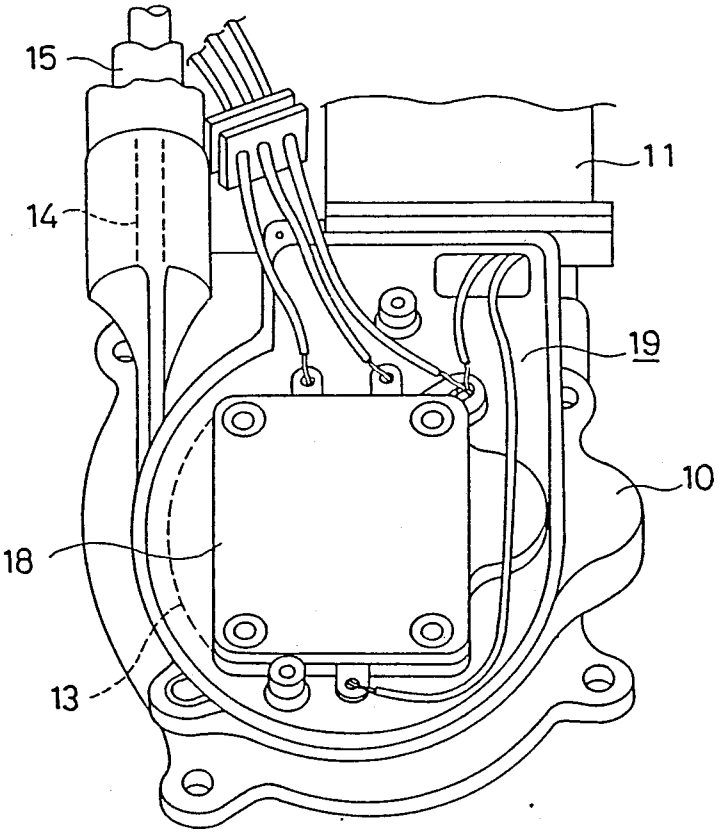

FIGS. 1 and 2 are overall views which outline one embodiment of the present invention. FIG. 1 is a front view of the device with the cover removed. FIG. 2 is a front view of the device with both the cover and the contact assembly removed.

In FIGS. 1 and 2, the attachment base 10 for the antenna drive mechanism has a motor 11 mounted on it, a gear mechanism 12, a wire feed mechanism 13 and an antenna extension and retraction operating wire 14 mounted on it. Rotation of motor 11 in the forward or reverse direction, extends or retracts the antenna 15 which consists of a multiple number of conducting tubes of different diameters which are connected so that they are free to slide telescopically relative to each other.

As shown in FIG. 2, one portion of the gear mechanism 12 projects from the surface of the partition wall 16 of the attachment base 10. Gear teeth which are formed around the circumference of a contact plate 17 engage with this portion of the gear mechanism 12. Furthermore, as shown in FIG. 1, a contact assembly 18 is mounted such that it covers the contact plate 17 and portion of the gear mechanism 12, and necessary wiring 19 is provided.

Figure 3:
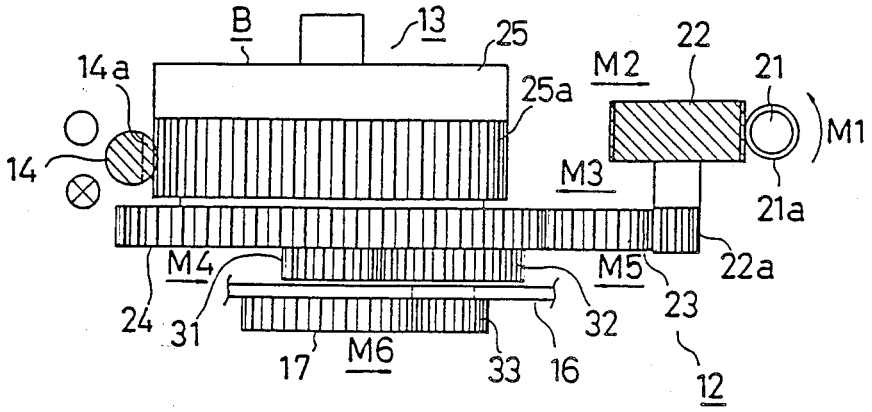

FIG. 3 is a top view illustrating the gear mechanism 12, wire feed mechanism 13, antenna extension and retraction operating wire 14, contact plate 17, and the revolving shaft 21 of motor 11. A worm wheel 22 engages a worm 21*a* formed around the circumference of motor shaft 21. A transmission gear 23 engages gear teeth 22*a* which are formed around the circumference of the rotary shaft of worm wheel 22. Gear teeth 24*a* of a driving-side clutch plate 24 which forms a portion of wire feed mechanism 13 engage with the transmission gear 23. Gear teeth 25*a* are formed around the circumference of driven-side clutch plate 25 linked to a driving-side clutch plate 24 via a clutch mechanism not shown in the Figures. A rack part 14*a* formed on the circumference of antenna extesion and retraction operating wire 14 along the direction of the length of the wire engages gear teeth 25*a*. Furthermore, in FIG. 3, first gear 31, second gear 32 and third gear 33 transmit the rotation of the driving-side clutch plate 24 to the contact plate 17 at a prescribed reduction ratio.

Figure 4:
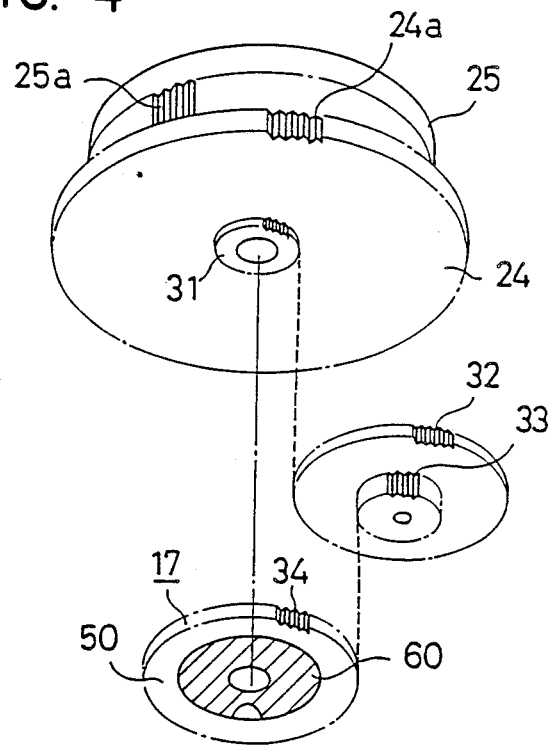

FIG. 4 is an exploded oblique view which illustrates first, second and third gears 31, 32 and 33 along with driving-side clutch plate 24, driven-side clutch plate 25 and contact plate 17. As is shown in FIG. 4, the first gear 31 is a small spur gear (Z=13) which forms an integral part of driving-side clutch plate 24 in the center of the back surface of clutch plate 24. The second gear 32 is a spur gear (Z=39) which has a larger number of teeth than the first gear 31, and which is installed so that it engages with the first gear 31. The third gear 33 is a small spur gear (Z=13) which forms an integral part of second gear 32 in the center of the back surface of second gear 32.

Figure 5:
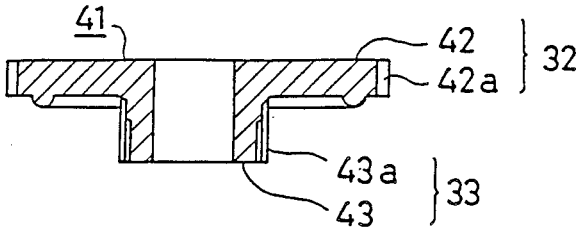

FIG. 5 is a cross section which illustrates the structures of second and third gears 32 and 33. As shown in the Figure, the second gear 32 is formed by forming gear teeth 42*a* around the circumference of the large-diameter disk part 42 of the gear base 41, while the third gear 33 is formed by forming gear teeth 43*a* around the circumference of a cylindrical shaft part 43 which projects from the center of one side of gear base 41.

As described above, in FIG. 4 the second gear 32 and third gear 33 are mounted so that the third gear 33 projects from the surface of partition plate 16 of attachment base 10. Thus, the gear teeth of contact plate 17 act as a fourth gear 34 engaging the third gear 33. This contact plate 17 consists of a rotary plate 50 which forms the base of fourth gear 34, and a conducting plate 60 which is integrally joined to one side surface of rotary plate 50.

Figure 6A:
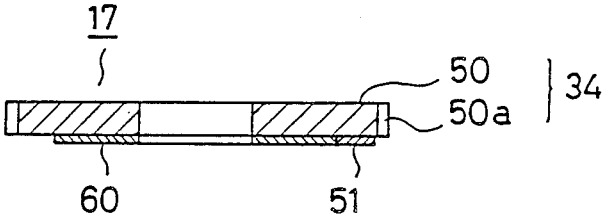

FIGS. 6(*a*) and 6(*b*) are a cross section and a plan view which illustrate the structure of contact plate 17. As shown in FIGS. 6(*a*) and 6(*b*), fourth gear 34 is constructed by forming gear teeth 50*a* around the circumference of rotary plate 50 which has approximately the same diameter as the disk part 42 which forms second gear 32. Furthermore, a finger-nail-shaped projection 51 is formed near the circumference on the side of rotary plate 50 to which conducting plate 60 is joined. The washer-shaped conducting plate 60 has a small cut-out area 61 formed in one part of its circumference, and is joined the side surface of rotary plate 50 so that cut-out area 61 fits over fingernail-shaped projection 51. Furthermore, as in FIG. 6(*a*), the thickness of conducting plate 60 is set so that the surface of projection 51 and the surface of the conductive plate 60 are even with each other.

Thus, contact plate 17 is caused to rotate continuously by the rotation of the motor 11 transmitted via the aforementioned reduction gear group, and is so designed that it completes approximately one cycle, (i.e., a rotation of about 235 degrees) in the time required for the antenna to complete its extension or retraction.

Figure 7:
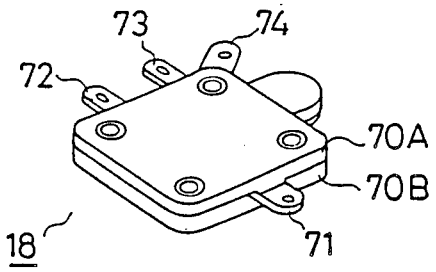
Figure 8:
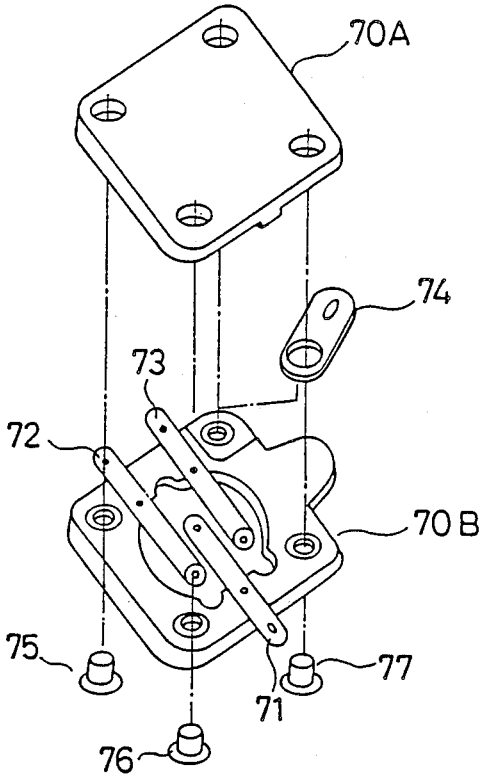

FIG. 7 is an oblique view of a contact assembly 18 and FIG. 8 is an exploded oblique thereof. As is shown in FIGS. 7 and 8, the contact assembly 18 is constructed as follows: three leaf spring contacts 71, 72 and 73 and a relay terminal 74 are clamped between top holder 70A and bottom holder 70B consisting of insulating parts which can be separated from each other. Holders 70A and 70B are fastened together to form an integral unit by means of eyelets 75, 76, 77 and 78 (78 is not shown).

Figure 9:
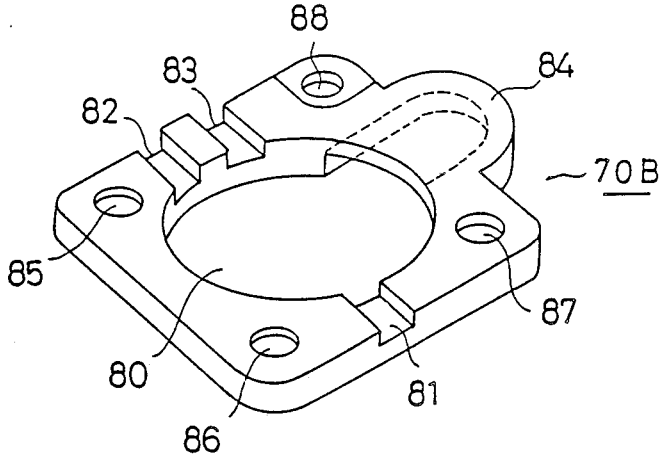

FIG. 9 is an oblique view which illustrates the structure of the bottom holder 70B. As shown in the Figure, the bottom holder 70B is roughly square in terms of overall shape, and has a central hole 80 into which contact plate 17 fits. In addition, grooves 81, 82 and 83 which hold the three leaf spring contacts 71, 72 and 73 are formed in the surface of the bottom holder 70B which joins with the top holder 70A. One side of bottom holder 70B is caused to bulge outward, and a cover 84 consisting of an indentation for the third gear 33 is formed on the undersurface of this bulging area. Furthermore, holes 85, 86, 87 and 88 for the eyelets 75, 76, 77 and 78 are formed in the four corners of bottom holder 70B.

Figure 10:
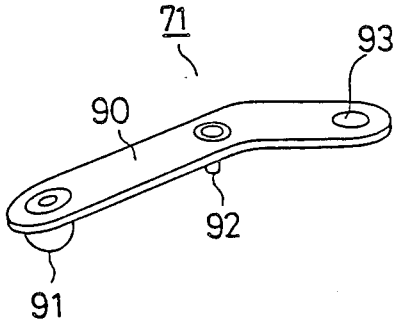

FIG. 10 illustrates the structures of the leaf spring contacts 71, 72 and 73, using the contact 71 as an example. As shown in this Figure, a contact point 91 is fused to the tip of a leaf spring 90 which is bent into the shape of a boomerang. A fastening projection 92 is formed in the central portion of leaf spring 90, and a terminal hole 93 for wiring connection is formed at the base end of the leaf spring 90. The other contacts 72 and 73 have basically the same stucture as contact 71. The only difference is that the length of the leaf spring 90, i.e., the distance from the base end to the contact point 91, is slightly longer in the contacts 72 and 73. The contact points 91 of the contacts 71, 72, 73 constitute the first through third contacts of the present invention, respectively.

Figure 6B:
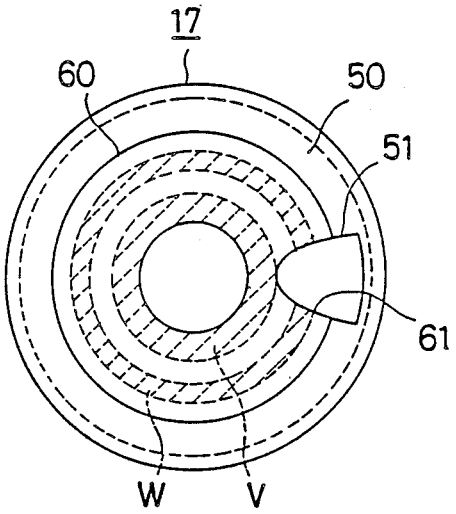

The contact point 91 of the contact 71 contacts the inside contact region V of conducting plate 60 shown in FIG. 6(b). The contact points 91 of the contacts 72 and 73 similarly contact the outside contact region W of conducting plate 60 shown in FIG. 6(b). Thus, the first contact 71 constantly contacts the conducting plate 60 so that a state of electrical continuity is maintained, regardless of the state of rotation of the contact plate 17. Furthermore, the second contact 72 contacts conducting plate 60 during extending action of the antenna 15 so that a state of electrical continuity is maintained. However, when extension of the antenna 15 is completed, this second contact contacts the cut-out area 61, i.e., projection 51 so that a state of electrical non-continuity is created. Furthermore, the third contact 73 contacts conducting plate 60 when the antenna 15 is retracted so that a state of electrical continuity is maintained. However, when retraction of the antenna 15 is completed, this third contact contacts the cut-out area 61, i.e., projection 51, so that a state of electrical non-continuity is created.

Figure 11:
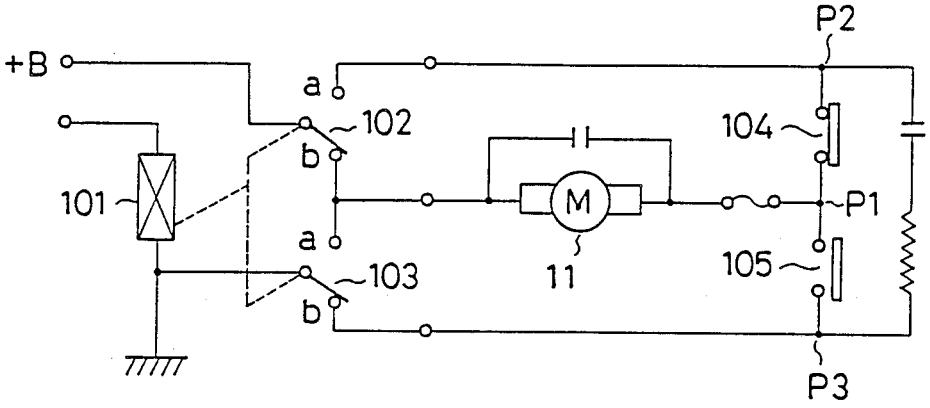

FIG. 11 illustrates the antenna drive control circuit used in this embodiment of the present invention. In FIG. 11, a relay 101 is power-controlled by the ignition switch of an automobile or ON-OFF switch of a transceiver set or the like. A forward or reverse current is caused to flow to motor 11 by a pair of switching contacts 102 and 103 belonging to this relay 101, so that motor 11 is caused to rotate in the forward direction or reverse direction. An antenna extension limit switch 104 and an antenna retraction limit switch 105 are inserted respectively in the forward and reverse current supply paths to the motor 11. The limit switches 104 and 105 are formed by the contact plate 17 and contact assembly 18. Specifically, the terminal of contact 71 which constitutes the first contact is connected to connection point P1; the terminal of the contact 72 which constitutes the second contact is connected to connection point P2; and the terminal of the contact 73 which constitutes the third contact is connected to connection point P3. As a result, when the antenna 15 is retracted, the cut-out area 61 of the conducting plate 60 is located at the position of the third contact (contact 73), so that the circuit between the first contact and the third contact, i.e., between connection point P1 and connection point P3, is interrupted, while the circuit between the first contact and the second contact, i.e., between connection points P1 and P2, is closed. This is the configuration shown in FIG. 11.

Still referring to FIG. 11, when relay 101 is powered in order to extend the antenna 15, so that the switching contacts 102 and 103 are both switched to the "a" side, current from the DC power supply (+B) flows through a circuit consisting of the "a" side of switching contact 102, limit switch 104, motor 11, the "a" side of switching contact 103 and the ground. As a result, the motor 11 rotates in the forward direction, and the antenna 15 is extended.

Referring to FIG. 3, when the motor shaft 21 rotates in the direction indicated by arrow M1, worm wheel 22 rotates in the direction indicated by arrow M2, transmission gear 23 rotates in the direction indicated by arrow M3, and driving-side clutch plate 24 and driven-side clutch plate 25 rotate in the direction indicated by arrow M4. Accordingly, the rack-equipped wire 14 which engages with the gear teeth **25*a* on the circumference of the driven-side clutch plate 25 is fed upward. As a result, the antenna 15** is pushed upward and extended.

In this case, since the first gear 31 which is installed as an integral part of the driving-side, the clutch plate 24, rotates in the same direction as the clutch plate 24, the second gear 32 and third gear 33 rotate in the direction indicated by arrow M5. Accordingly, contact plate 17 rotates in the direction indicated by arrow M6. As a result of the rotation of contact plate 17, the position of the cut-out area 61 in the conducting plate 60 gradually shifts. Accordingly, after initiation of rotation, the third contact also contacts the conducting plate 60 so that a state of electrical continuity is established. Specifically, there is electrical continuity exists between the connection points P1 and P3 in FIG. 11, so that the limit switch 105 is closed.

When the extending action of antenna 15 is completed, the position of the cut-out area 61 the in conducting plate 60 corresponds exactly to the position of the first contact. As a result, contact between the first contact and the conductive plate 60 is broken, so that a state of electrical non-continuity is established. Specifically, the circuit path between connection points P1 and P2 in FIG. 11 is interrupted, so that the limit switch 104 is open. As a result, current flow to the motor 11 is cut off, and the extending action of the antenna 15 stops. Furthermore, at this time, the clutch mechanism between the clutch plates 24 and 25 is also disengaged. However, since the motor power supply is cut off as described above, there are no particular problems even if the clutch mechanism should temporarily fail to operate.

Further, referring to FIG. 11, when the power to the relay 101 is cut off in order to retract antenna 15, switching contacts 102 and 103 are switched back to the "b" side. As a result, current from the DC power supply (+B) flows through a circuit consisting of the "b" side of switching contact 102, motor 11, limit switch 105, the "b" side of switching contact 103 and the ground. Accordingly, the motor 11 rotates in the reverse direction. As a result, the gear group rotates in an opposite manner from rotation which occurs during extension of the antenna, so that the antenna is retracted. At the same time, contact plate 17 rotates in the reverse direction. As a result, after initiation of rotation, the limit switch 104 is closed. When retraction of antenna 15 is completed, the cut-out area 61 is located at the position of the third contact. Accordingly, the circuit path between the connection points P1 and P3 is interrupted, so that the limit switch 105 is open. Thus, current flow to the motor 11 is cut off at the same time that retraction of the antenna 15 is completed.

Thus, in this embodiment, contact plate 17 rotates continuously as a result of the rotation of the driving-side clutch plate 24 being transmitted to contact plate 17 via the first through third gears 31 through 33. Furthermore, leaf spring contacts 71 through 73, which constitute the first through third contacts, contact the conducting plate 60 which has the cut-out area 61 and which is joined to contact plate 17 with a prescribed positional relationship, so that limit switches 104 and 105 for antenna extension and retraction are formed.

Accordingly, unlike conventional devices in which the limit switch off action is accomplished by means of a switch gear which rotates in steps, the device of the present invention does not suffer from rotation angle errors caused by such a step action. As a result, the angles of rotation rotary plate 50 at which the limit switches are to be turned off can be accurately matched with the amount of feed of wire 14 required for extension and retraction of the antenna 15. Accordingly, when extension or retraction of antenna 15 is completed, no excessive compressive or tensile force is applied to the extension and retraction operating wire 14. Furthermore, timing of power supply cut-off to motor 11 can be accurately matched to the point in time at which extension or retraction of the antenna is completed, or can be set immediately prior to this point in time. Accordingly, it would also be possible to omit the clutch mechanism. Furthermore, since the load on the extension and retraction operating wire 14 is lightened, the wire 14 can be made thinner than in conventonal devices. As a result, winding of wire 14 on a drum or the like is facilitated, so that winding can be performed more smoothly. Furthermore, rubbing sounds and knocking sounds which may occur during feeding of wire 14 are decreased and noise is therefore minimized.

The present invention is not limited to the embodiment described above. For example, in the above embodiment, a conducting plate 60 consisting of a metal plate joined to a rotary plate 50 is used as a conducting part. However, it would also be possible to form a conducting part on the surface of the rotary plate 50 by means such as vacuum evaporation of a metallic thin film in a prescribed pattern. Furthermore, in the above embodiment, the cut-out area 61 was shown being open at the periphery; however, this cut-out area could also be an independent hole-shaped cut-out. Furthermore, it goes without saying that various other modifications may be made without departing from the spirit of the present invention.

In the device of the present invention, limit switches are formed by installing a conducting part with a cut-out area as an integral part of rotary plate which is caused to rotate continuously by revolution of a motor causing the first through third contacts to contact this conducting part in a prescribed positional relationship so that electrical continuity is established. Accordingly, the motor power supply can be accurately cut off at the point in time or immediately prior to such point in time at which extension or retraction of the antenna is completed. Thus, application of unnecessary or excessive force to the antenna extension and retraction operating wire can be prevented, and a drive control device for an electrically-driven extending and retracting antenna can be obtained which is superior in terms of durability, and therefore offers the prospect of highly reliable operation over a long period of time.

I claim:

1. A drive control device for an electrically driving an extending and retracting antenna system comprising:

a rotary plate continuously rotatable by rotation of a drive motor of said antenna via a reduction gear mechanism, said rotary plate rotating approximately once in the time required to complete extension or retraction of said antenna;

a washer-shaped conducting part attached to one side surface of said rotary plate, said conducting part having a small cut-out area formed in one part of its circumference which is non-conducting;

a first contact continuously in electrical contact with said conducting part;

a second contact provided such that said second contact is in continuous electrical contact with said conducting part until extension of said antenna is completed and when extesion of said antenna is completed, said second contact is in contact with said non-conducting small cut-out area and not in electrical contact with said conducting part; and a third contact provided such that said third contact is in continuous electrical contact with said conducting part until retraction of said antenna is completed and when retraction said antenna is completed, said third contact is in contact with said non-conducting small cut-out area and not in electrical contact with said conducting part;

whereby said first and second contacts provide a limit switch for extension of said antenna and said first and third contacts provide a limit switch for retraction of said antenna.

2. An antenna system according to claim 1, wherein:

said rotary plate is disk shaped; and said first, second and third contacts are boomerang shaped leaf springs.

3. An electrically driven extending and retracting antenna comprising a telescopic antenna element, an antenna extension and retraction operating wire, a wire feed mechanism, a clutch mechanism, a reduction gear mechanism, a drive motor and a drive control device, said drive control device comprising:

a rotary plate continuously rotatable by rotation of said drive motor via a reduction gear mechanism so that said rotary plate rotates approximately once in the time required to complete extension or retraction of said antenna;

an electrically conductive conducting part attached to one side surface of said rotary plate and provided with a small non-conducting cut-out area formed in one part of its circumference;

a first contact provided such that said first contact is in continuous electrical contact with said conducting part;

a second contact provided such that said second contact is in continuous electrical contact with said conducting part until extension of said antenna is completed and when extension of said antenna is completed, said second contact is in contact with said non-conducting small cut-out area and not in electrical contact with said conducting part; and a third contact provided such that said third contact is in continuous electrical contact with said conducting part until retraction of said antenna is completed and when retraction of said antenna is completed, said third contact is in contact with said non-conducting small cut-out area and not in electrical contact with said conducting part;

whereby said first and second contacts provide a limit switch for extension of said antenna and said first and third contacts provide a limit switch for retraction of said antenna.

* * * * *